US009478918B1

(12) United States Patent
Yin et al.

(10) Patent No.: US 9,478,918 B1
(45) Date of Patent: Oct. 25, 2016

(54) USB CONNECTOR HAVING A TONGUE WITH A PLURALITY OF CONTACTS ON ITS UPPER AND LOWER SIDES SYMMETRICALLY AND REVERSELY ARRANGED

(71) Applicants: Zheng-Kai Yin, Shenzhen (CN); Calvin Shie-Ning Wang, Cayman Islands (KY)

(72) Inventors: Zheng-Kai Yin, Shenzhen (CN); Calvin Shie-Ning Wang, Cayman Islands (KY)

(73) Assignees: Zheng-Kai Yin, Huangshi (CN); Calvin Shie-Ning Wang, Los Angeles ( * ) Notice: Subject to any disclaimer, the term of this patent is extended or adjusted under 35 U.S.C. 154(b) by 0 days.

(21) Appl. No.: 14/808,477

(22) Filed: Jul. 24, 2015

(30) Foreign Application Priority Data

Apr. 10, 2015 (CN) ..... 2015 1 0168086

(51) Int. Cl.
*H01R 29/00* (2006.01)
*H01R 13/66* (2006.01)
*H01R 13/642* (2006.01)

(52) U.S. Cl.
CPC ..... *H01R 13/665* (2013.01); *H01R 13/642* (2013.01); *H01R 29/00* (2013.01)

(58) Field of Classification Search
CPC .... H01R 13/055; H01R 13/60; H01R 24/60; H01R 27/00; H01R 29/00; H01R 33/90
USPC ..... 439/172–174, 217, 218, 660
See application file for complete search history.

(56) References Cited

U.S. PATENT DOCUMENTS

| | | | | |
|---|---|---|---|---|
| 7,361,059 | B2 | 4/2008 | Harkabi et al. | |
| 7,500,861 | B2 | 3/2009 | Harkabi et al. | |
| 7,717,717 | B1 * | 5/2010 | Lai | H01R 13/64 439/66 |
| 8,799,527 | B2 * | 8/2014 | Mullins | H04M 1/0274 710/16 |
| 8,891,216 | B2 * | 11/2014 | Mullins | H04M 3/08 361/58 |
| 9,142,926 | B2 * | 9/2015 | Tsai | H01R 24/60 |
| 9,293,876 | B2 * | 3/2016 | Terlizzi | H01R 29/00 |
| 9,350,125 | B2 * | 5/2016 | Jones | H01R 24/60 |

FOREIGN PATENT DOCUMENTS

| | | |
|---|---|---|
| CN | 203180125 A | 9/2013 |
| CN | 104124569 | 10/2014 |

* cited by examiner

*Primary Examiner* — Chandrika Prasad
(74) *Attorney, Agent, or Firm* — Zhigang Ma

(57) ABSTRACT

A universal serial bus (USB) connector includes a case, an insulation tongue, a plurality of spaced electric conduction bars installed to the insulation tongue, a resilient supporting pole connected between the insulation tongue and the case, and two rows of electric coupling pins respectively located above and below the insulation tongue. The electric conduction bars are spaced in a horizontal direction of the insulation tongue. The top surface of each electric conduction bar faces the corresponding electric coupling pin locating above the insulation tongue, and the bottom surface of each electric conduction bar faces the corresponding electric coupling pin locating below the insulation tongue. The electric coupling pins locating above the insulation tongue and the electric coupling pins locating below the insulation tongue are reversely and symmetrically arranged by type.

6 Claims, 26 Drawing Sheets

USB CONNECTOR HAVING A TONGUE WITH A PLURALITY OF CONTACTS ON ITS UPPER AND LOWER SIDES SYMMETRICALLY AND REVERSELY ARRANGED

FIELD

The subject matter herein generally relates to a universal serial bus (USB) connector and an electronic device with the USB connector.

BACKGROUND

A fool-proofing structure or an inserting direction mark is generally used in a pair of USB connectors to prevent wrong coupling between the pair of USB connectors.

BRIEF DESCRIPTION OF THE DRAWINGS

Implementations of the present technology will now be described, by way of example only, with reference to the attached figures.

DETAILED DESCRIPTION

Figure 1:
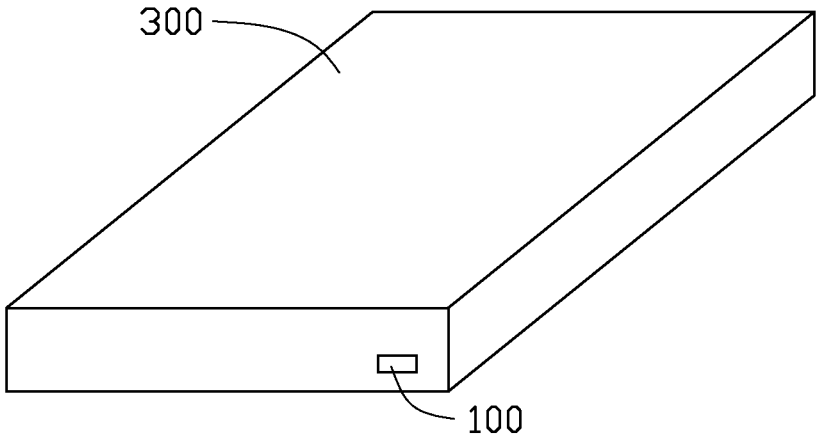
FIG. 1 is an isometric view of an electronic device, wherein the electronic device includes a universal serial bus (USB) connector.
Figure 2:
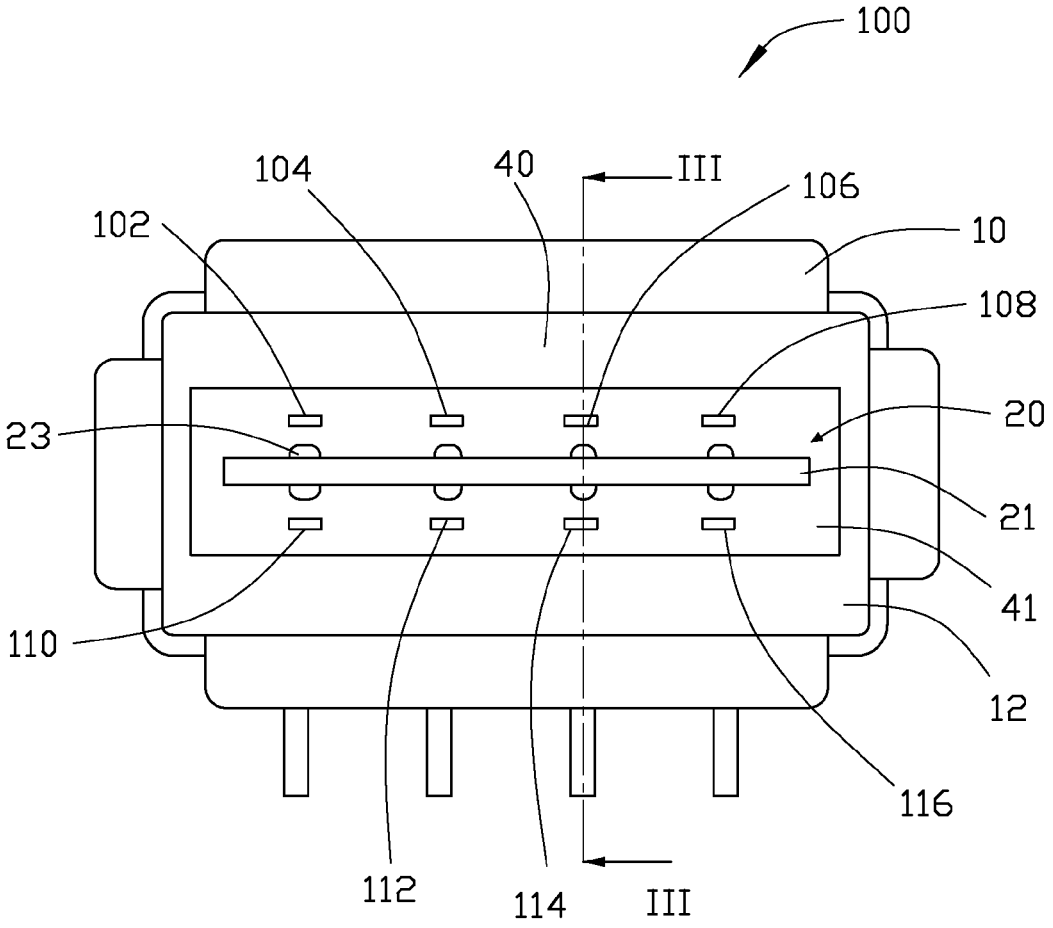
FIG. 2 is a front elevational view of a first embodiment of the USB connector of FIG. 1, wherein the USB connector includes an installation assembly.
Figure 3:
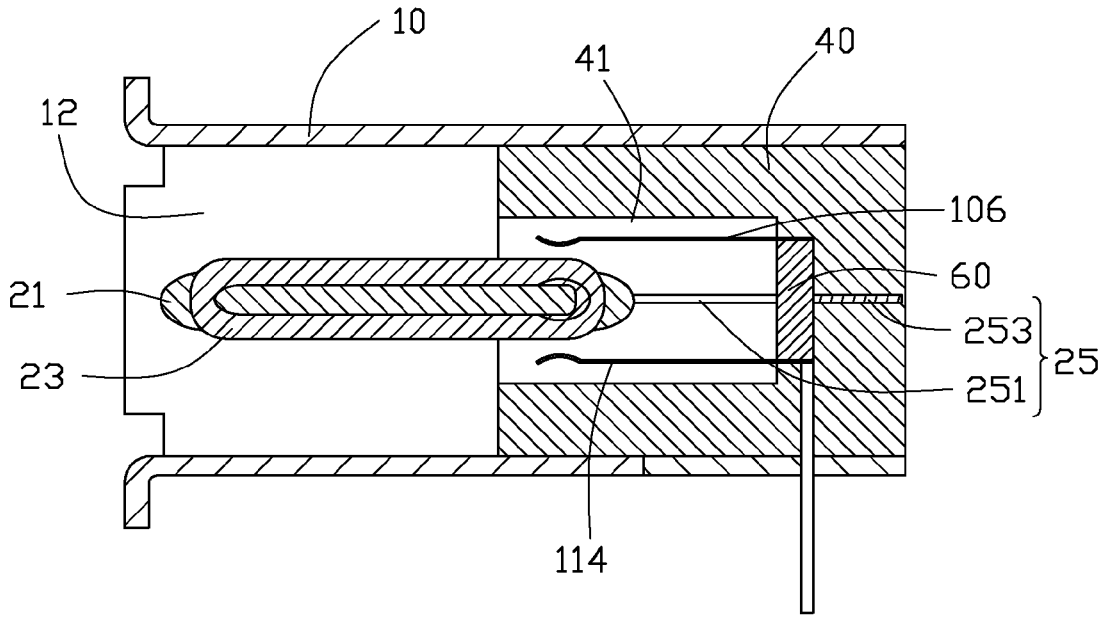
FIG. 3 is a cross sectional view of FIG. 2, taken along line III-III.
Figure 4:
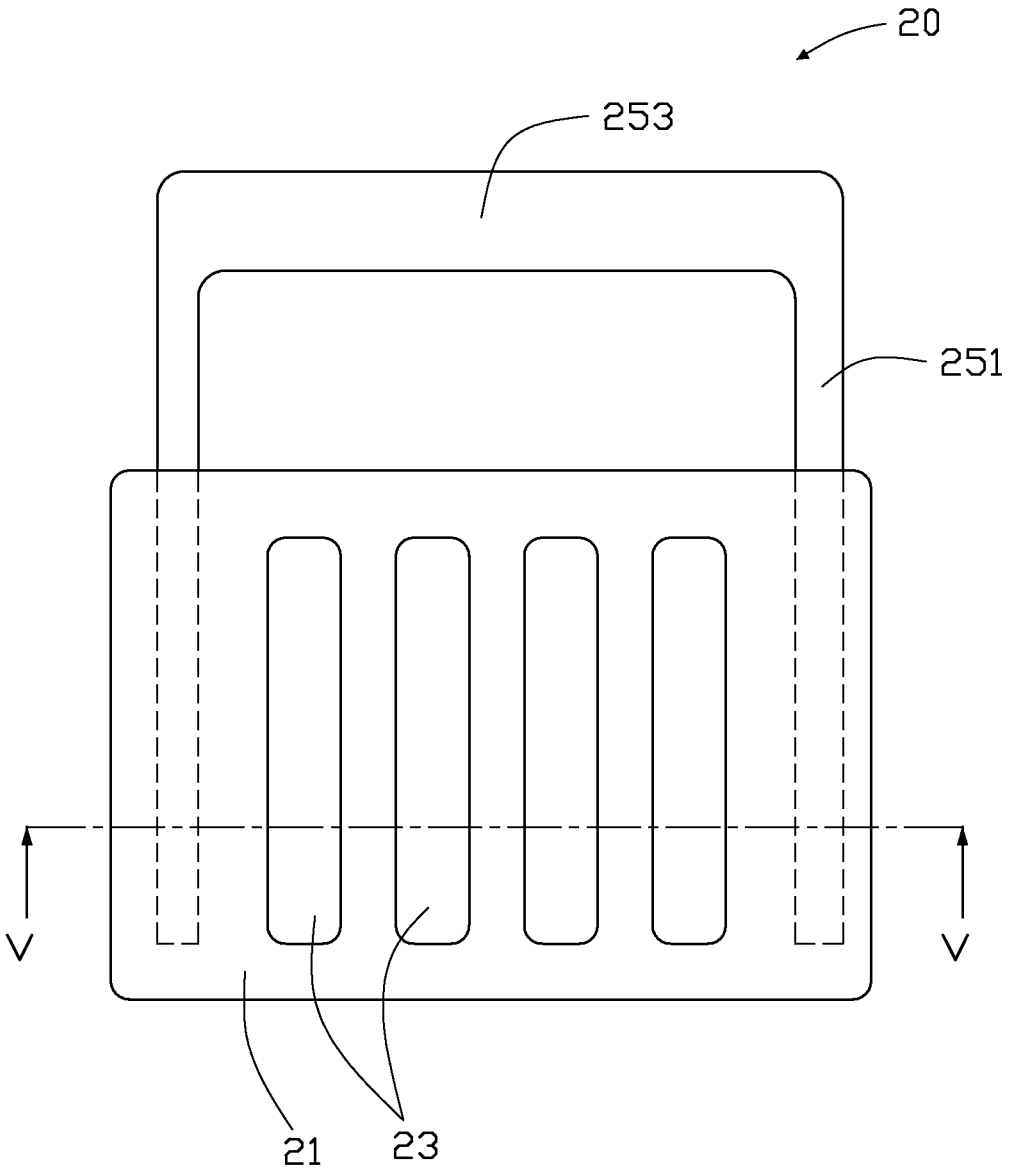
FIG. 4 is a top plan view of the installation assembly of FIG. 2.
Figure 5:
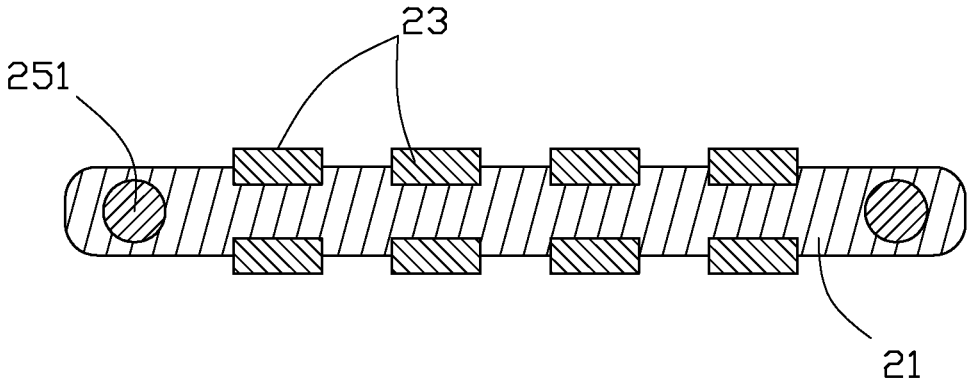
FIG. 5 is a cross sectional view of FIG. 4, taken along line V-V.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

The present disclosure is described in relation to an electronic device.

FIG. 1 illustrates an electronic device comprising a main body 300 and a universal serial bus (USB) connector 100 located on the main body 300. The USB connector 100 is electrically coupled to the main body 300, to transmit data or charge the main body 300. The electronic device can be a computer, a game machine, a mobile phone, a camera, a TV, a CD player, or a navigation GPS and so on.

FIGS. 2-5 illustrate a first embodiment of the USB connector 100, and the USB connector 100 is a USB 2.0 jack or a USB 1.1 jack. The USB connector 100 comprises a case 10, an installation assembly 20 received in a middle of the case 10, a mounting block 40, a double sided circuit board 60, and two rows of electric coupling pins respectively located above and below the installation assembly 20. A front end of the case 10 defines an inlet hole 12 opposite to the installation assembly 20. The mounting block 40 is mounted in a rear end of the case 10 away from the inlet hole 12. A middle of a front surface of the mounting block 40 defines a receiving space 41 opposite the inlet hole 12. The installation assembly 20 comprises an insulation tongue 21, four spaced and electric conduction bars 23 installed to the insulation tongue 21, and a bracket 25 received in the receiving space 41 and connected between the insulation tongue 21 and the mounting block 40. The electric conduction bars 23 are spaced in a left-to-right direction of the insulation tongue 21. An upper side and a lower side of a front end of the insulation tongue 21 are cambered. Each electric conduction bar 23 extends along a fore-and-aft direction of the insulation tongue 21, a top surface of each electric conduction bar 23 is exposed out of a top surface of the insulation tongue 21, and a bottom surface of each electric conduction bar 23 is exposed out of a bottom surface of the insulation tongue 21. The bracket 25 comprises two resilient supporting poles 251 connected to two opposite ends of the insulation tongue 21 and a connecting pole 253 connected between rear ends of the resilient supporting poles 251. The connecting pole 253 is mounted to the mounting block 40.

In the embodiment, the number of each row of electric coupling pins is four. Rear ends of the two rows of electric coupling pins are mounted to the mounting block 40, and front ends of the two rows of electric coupling pins are received in the receiving space 41. The top surface of each electric conduction bar 23 faces a corresponding one of the electric coupling pins locating above the insulation tongue 21, and the bottom surface of each electric conduction bar 23 faces a corresponding one of the electric coupling pins locating below the insulation tongue 21. The electric coupling pins above the installation assembly 20 are a first negative power supply coupling pin 102, a first positive signal power supply coupling pin 104, a first negative signal power coupling pin 106, and a first positive power supply coupling pin 108, in sequence from a first side to a second side of the receiving space 41. The electric coupling pins locating below the installation assembly 20 are a second positive power supply coupling pin 110, a second negative signal power coupling pin 112, a second positive signal power supply coupling pin 114, and a second negative power supply coupling pin 116, in sequence from the first side to the second side of the receiving space 41.

The double sided circuit board 60 is installed in the receiving space 41 of the mounting block 40 and electrically coupled to the main body 300. The first negative power supply coupling pin 102, the first positive signal power supply coupling pin 104, the first negative signal power coupling pin 106, and the first positive power supply coupling pin 108 are electrically coupled to a first side of the double sided circuit board 60. The second positive power supply coupling pin 110, the second negative signal power coupling pin 112, the second positive signal power supply coupling pin 114, and the second negative power supply coupling pin 116 are electrically coupled to a second side of the double sided circuit board 60. The first negative power supply coupling pin 102 is electrically coupled to the second negative power supply coupling pin 116 by the double sided circuit board 60. The first positive signal power supply coupling pin 104 is electrically coupled to the second positive signal power supply coupling pin 114 by the double sided circuit board 60. The first negative signal power coupling pin 106 is electrically coupled to the second negative signal power coupling pin 112 by the double sided circuit board 60. The first positive power supply coupling pin 108 is electrically coupled to the second positive power supply coupling pin 110 by the double sided circuit board 60.

In another embodiment, a single sided circuit board or a plurality of wires are installed in the receiving space 41 of the mounting block 40 and electrically coupled to the main body 300 of the electronic device. The first negative power supply coupling pin 102 is electrically coupled to the second negative power supply coupling pin 116 by the single sided circuit board or one of the wires. The first positive signal power supply coupling pin 104 is electrically coupled to the second positive signal power supply coupling pin 114 by the single sided circuit board or one of the wires. The first negative signal power coupling pin 106 is electrically coupled to the second negative signal coupling pin 112 by the single sided circuit board or one of the wires. The first positive power supply coupling pin 108 is electrically coupled to the second positive power supply coupling pin 110 by the single sided circuit or one of the wires.

Figure 6:
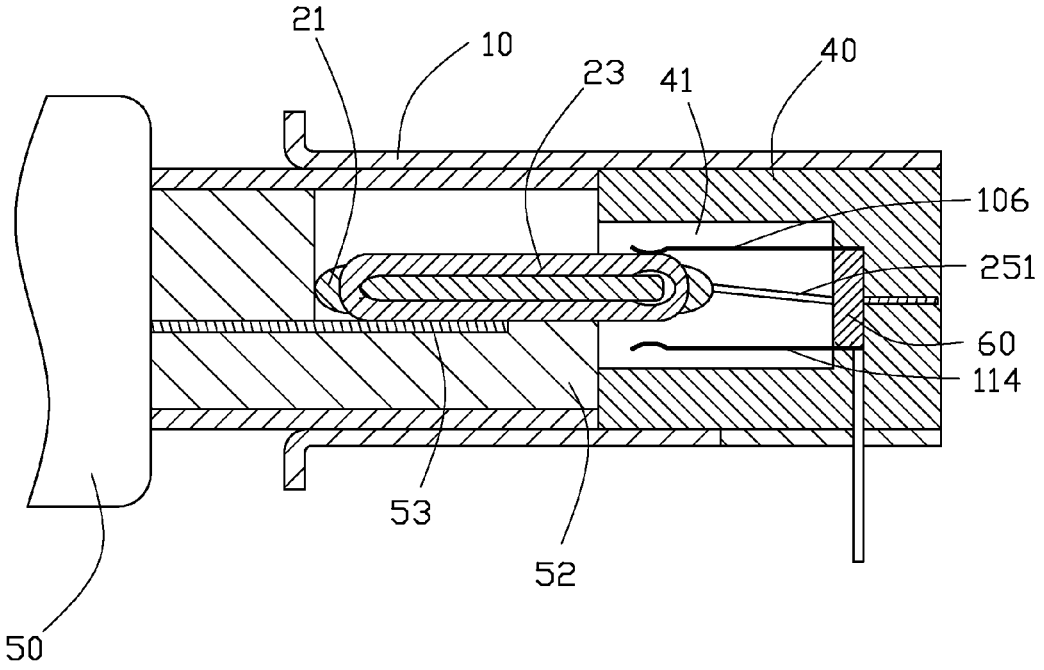
FIG. 6 is an assembled view of the USB connector of FIG. 3 and a common USB connector in a first state.

FIG. 6 illustrates the first embodiment of the USB connector 100 connecting with a common USB plug 50 in a first state. The common USB plug 50 comprises a tongue 52 and four electric conduction pieces 53 mounted on the tongue 52. In use, the common USB plug 50 is inserted in the USB connector 100. The tongue 52 of the common USB plug 50 presses the lower side of the front end of the insulation tongue 21, to move the installation assembly 20 up and deform the resilient supporting poles 251. The first negative power supply coupling pin 102, the first positive signal power supply coupling pin 104, the first negative signal power coupling pin 106, and the first positive power supply coupling pin 108 respectively abut against the top surfaces of the corresponding electric conduction bars 23. The electric conduction pieces 53 of the common USB plug 50 respectively abut against the bottom surfaces of the corresponding electric conduction bars 23. The common USB plug 50 is electrically coupled to the USB connector 100.

Figure 7:
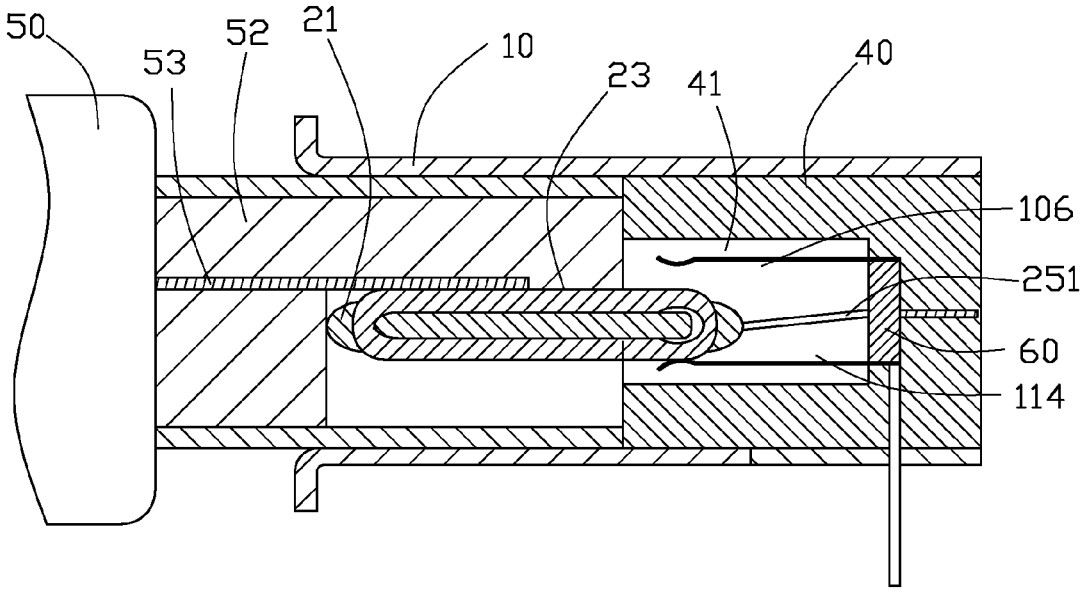
FIG. 7 is similar to FIG. 6, but shows the USB connector of FIG. 3 and the common USB connector in a second state.

FIG. 7 illustrates the first embodiment of the USB connector 100 connecting with the common USB plug 50 in a second state. The common USB plug 50 is pulled out from the USB connector 100, the resilient supporting poles 251 are restored to bias the installation assembly 20 to move back. The common USB plug 50 is inverted, and is inserted into the USB connector 100. The tongue 52 of the common USB plug 50 presses the upper side of the front end of the insulation tongue 21, to move the installation assembly 20 down and deform the resilient supporting poles 251. The second positive power supply coupling pin 110, the second negative signal power supply coupling pin 112, the second positive signal power coupling pin 114, and the second negative power supply coupling pin 116 are respectively abut against the bottom surfaces of the corresponding electric conduction bars 23. The electric conduction pieces 53 of the common USB plug 50 respectively abut against the top surfaces of the corresponding electric conduction bars 23. The common USB plug 50 is electrically coupled to the USB connector 100.

Figure 8:
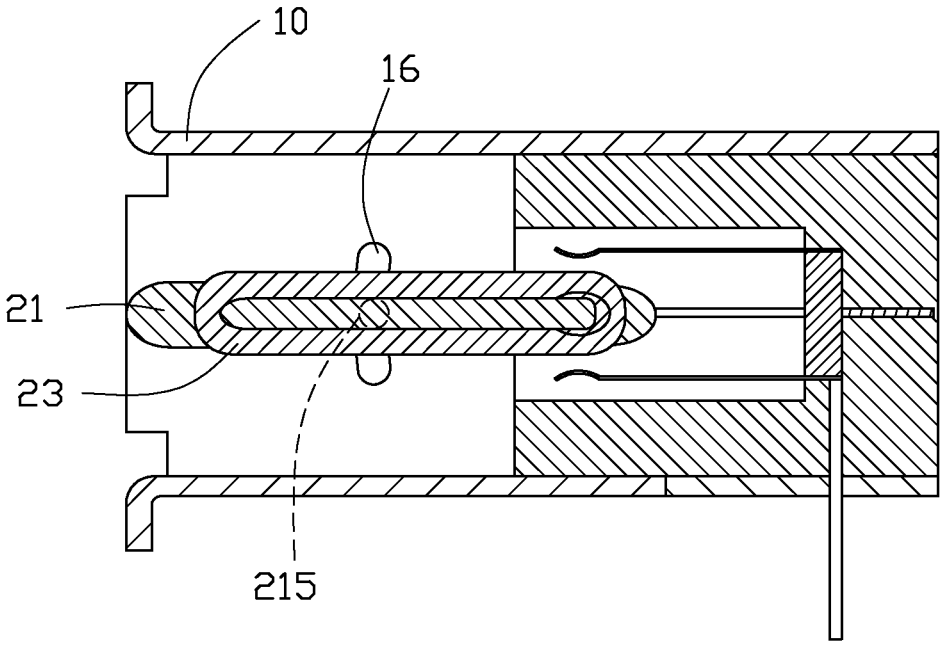
FIG. 8 is a side cross sectional view of a second embodiment of the USB connector of FIG. 1.

FIG. 8 illustrates a second embodiment of the USB connector 100, and the second embodiment of the USB connector 100 is substantially similar to the first embodiment of the USB connector 100. In the second embodiment, each of left and right sides of the case 10 defines an arc-shaped guiding slot 16 adjacent to the insulation tongue 21. Top and bottom ends of each guiding slot 16 are behind a middle of the guiding slot 16. Two sliding poles 215 extend out from two opposite sides of the insulation tongue 21, to be slidably received in the corresponding guiding slots 16.

Figure 9:
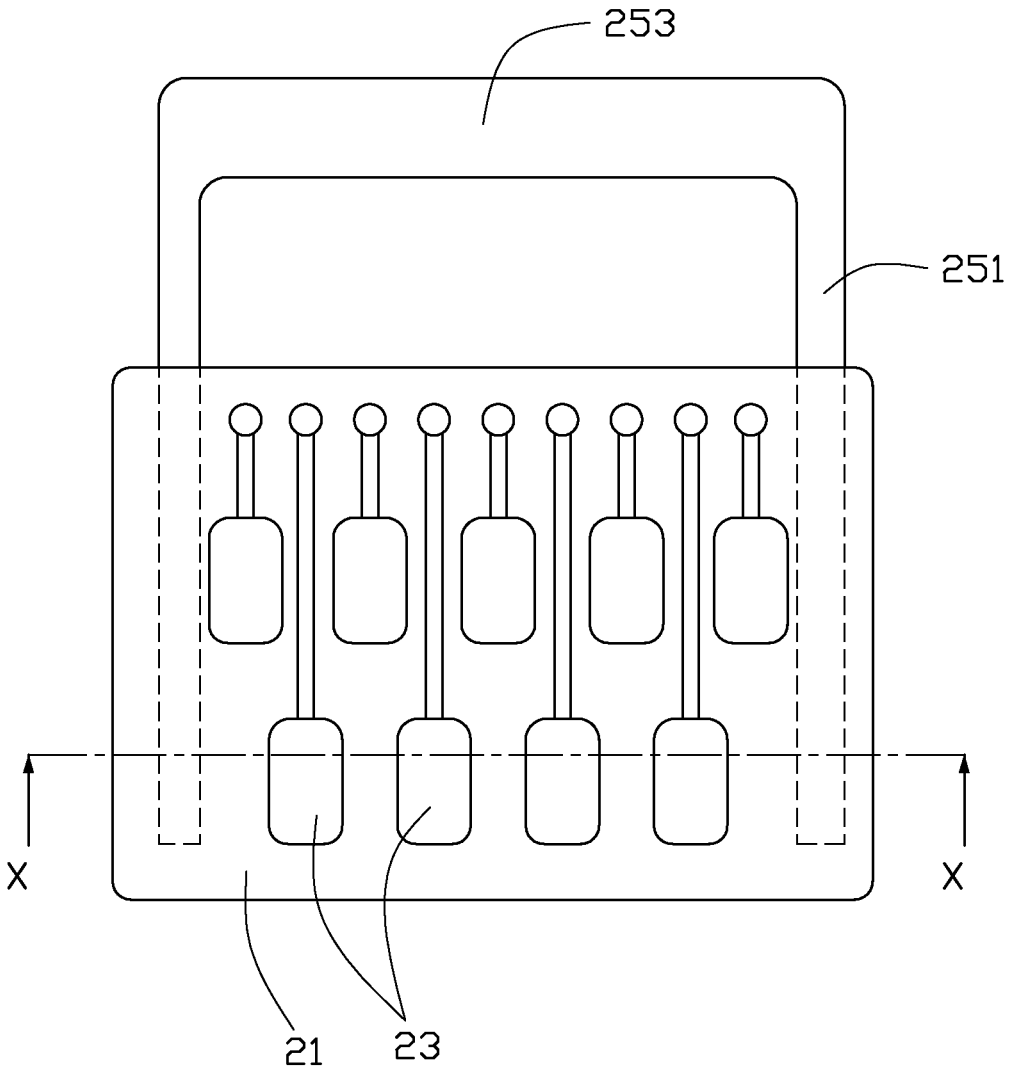
FIG. 9 is a top plan view of an installation assembly of a third embodiment of the USB connector of FIG. 1.
Figure 10:
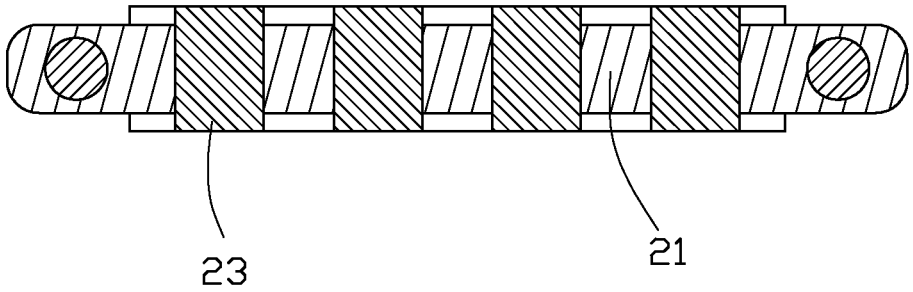
FIG. 10 is a cross sectional view of FIG. 9, taken along line X-X.
Figure 11:
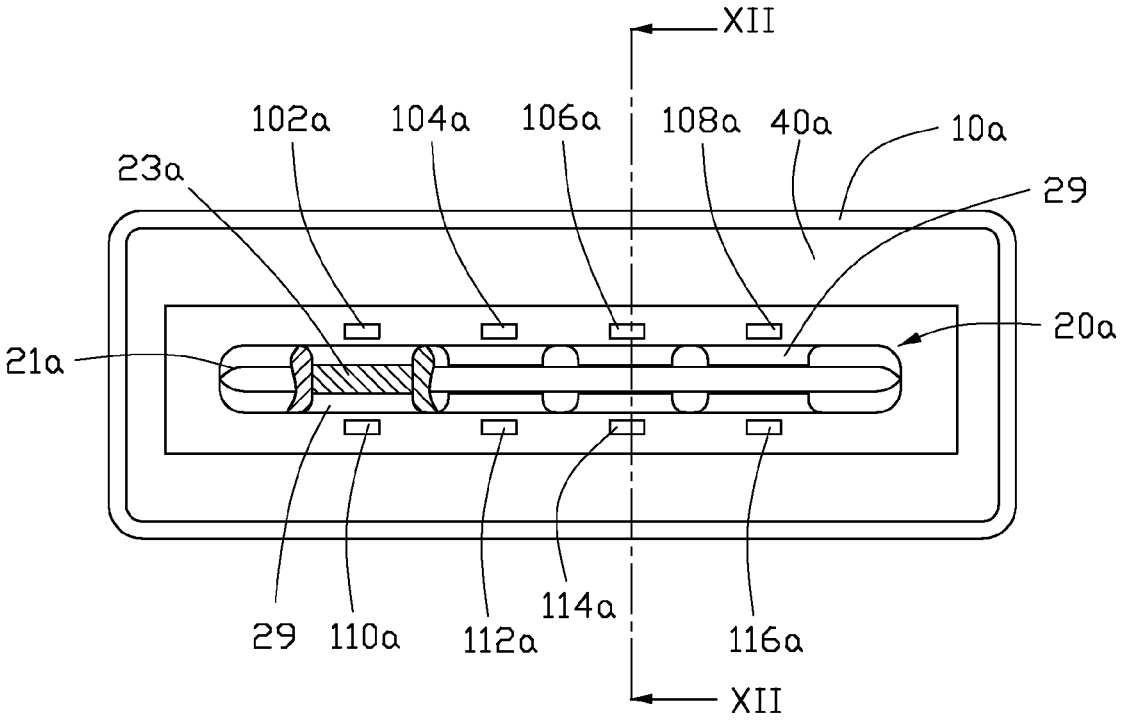
FIG. 11 is a front elevational and partial cross sectional view of a forth embodiment of the USB connector of FIG. 1, wherein the USB connector includes an installation assembly.
Figure 12:
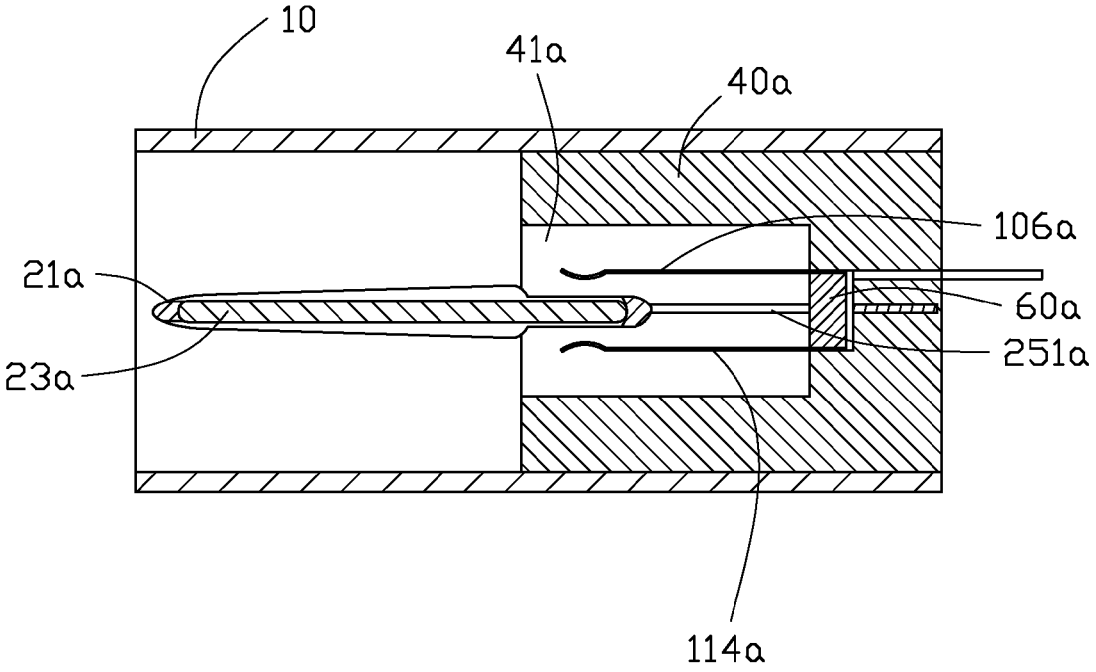
FIG. 12 is a cross sectional view of FIG. 11, taken along line XII-XII.
Figure 13:
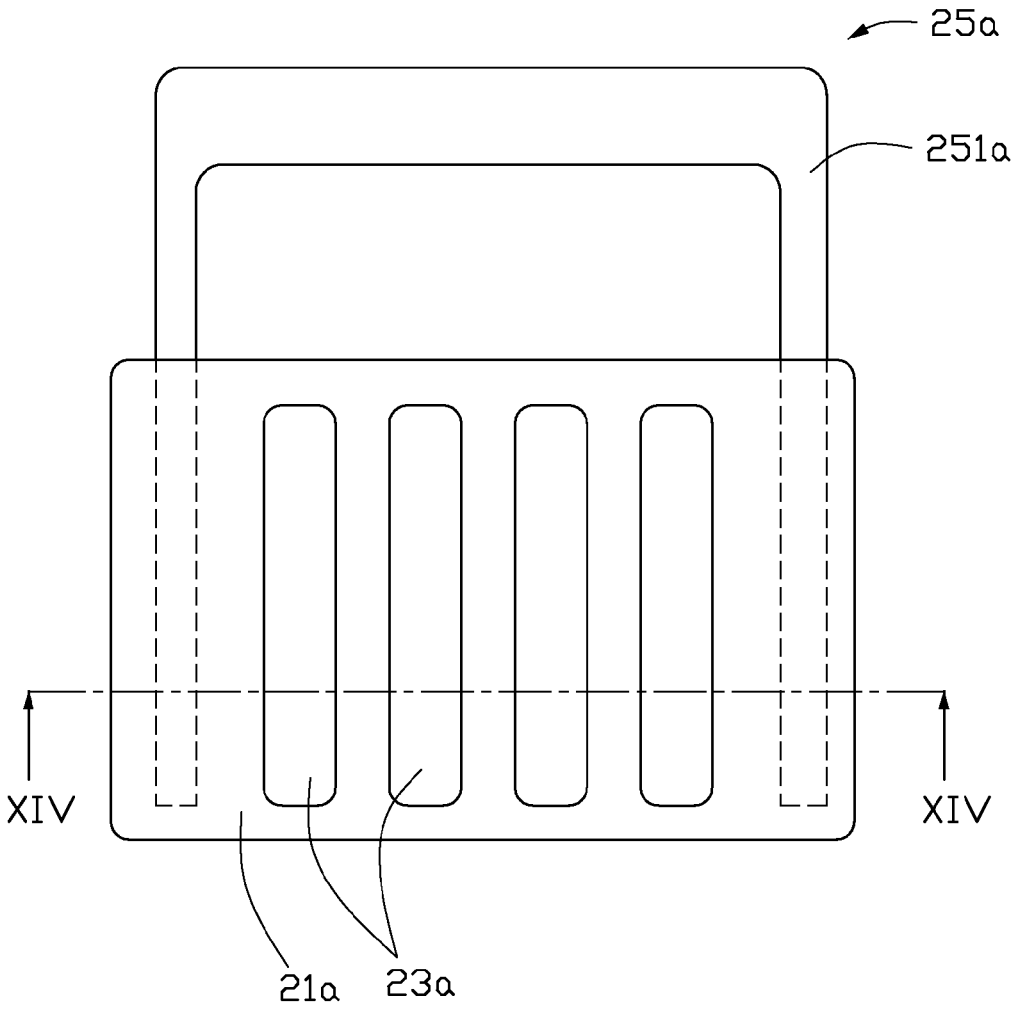
FIG. 13 is a top plan view of the installation assembly of FIG. 11.
Figure 14:
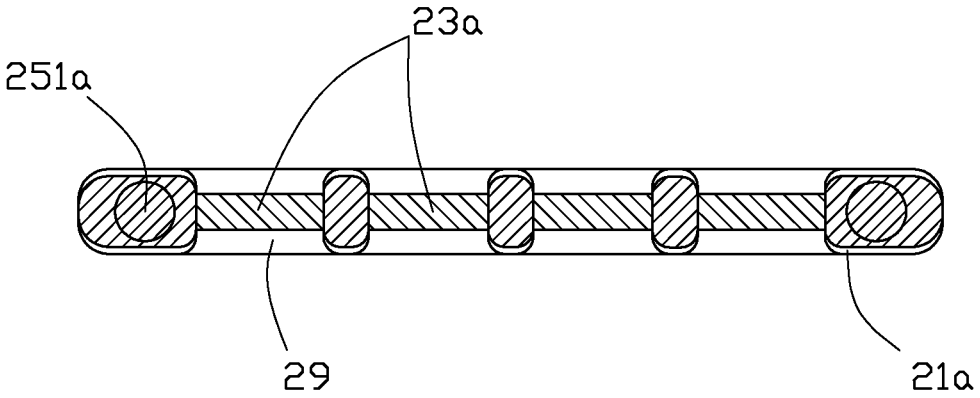
FIG. 14 is a cross sectional view of FIG. 13, taken along line XIV-XIV.

FIGS. 9-10 illustrate a third embodiment of the USB connector 100, and the third embodiment of the USB connector 100 is substantially similar to the first embodiment of the USB connector 100. In the third embodiment, the USB connector 100 is a USB 3.0 jack, and the USB connector 100 comprises nine electric conduction bars 23 installed to the insulation tongue 21, nine electric coupling pins located above the insulation tongue 21 and respectively aligning with the electric conduction bars 23, and nine electric coupling pins located below the insulation tongue 21 and respectively aligning with the electric conduction bars 23. The electric coupling pins locating above the insulation tongue 21 and the electric coupling pins locating below the insulation tongue 21 are reversely and symmetrically arranged by type.

In another embodiment, the USB connector 100 can be a Micro USB jack. The USB connector 100 comprises five electric conduction bars 23 installed to the insulation tongue 21, five electric coupling pins located above the insulation tongue 21 and respectively aligning with the electric conduction bars 23, and five electric coupling pins located below the insulation tongue 21 and respectively aligning with the electric conduction bars 23. The electric coupling pins locating above the insulation tongue 21 and the electric coupling pines locating below the insulation tongue 21 are reversely and symmetrically arranged by type.

In another embodiment, the USB connector 100 can be a USB 3.1 jack. The USB connector 100 comprises twelve electric conduction bars 23 installed to the insulation tongue 21, twelve electric coupling pins located above the insulation tongue 21 and respectively aligning with the electric conduction bars 23, and twelve electric coupling pins located below the insulation tongue 21 and respectively aligning with the electric conduction bars 23. The electric coupling pins locating above the insulation tongue 21 and the electric coupling pins locating below the insulation tongue 21 are reversely and symmetrically arranged by type.

In another embodiment, the connecting pole 253 of the bracket 25 can be omitted, and the bracket 25 only comprises a resilient supporting pole 251 connected between a middle of the rear end of the insulation tongue 21 and the mounting block 40.

FIGS. 11-14 illustrate a fourth embodiment of the USB connector 100, and the fourth embodiment of the USB connector 100 is substantially similar to the first embodiment of the USB connector 100. In the fourth embodiment, the USB connector is a USB 2.0 plug or a USB 1.1 plug, and the USB connector 100 comprises a case 10*a*, an installation assembly 20*a*, a mounting block 40*a*, a double sided circuit board 60*a*, and two rows of electric coupling pins respectively located above and below the installation assembly 20*a*. The installation assembly 20*a* comprises an insulation tongue 21*a*, four electric conduction bars 23*a*, and a bracket 25*a* connected between the insulation tongue 21*a* and the mounting block 40*a*. An upper side and a lower side of a front end of the insulation tongue 21*a* are cambered. A top surface of the insulation tongue 21*a* slantingly extends up from the front end of the insulation tongue 21*a*, and a bottom surface of the insulation tongue 21*a* slantingly extends down from the front end of the insulation tongue 21*a*. A middle of the insulation tongue 21*a* defines four spaced receiving slots 29 extending through the top and bottom surfaces of the insulation tongue 21*a*. The receiving slots 29 are spaced in a left-to-right direction of the insulation tongue 21*a*. The electric conduction bars 23*a* are respectively mounted in the receiving slots 29, and each electric conduction bar 23*a* is located between the top surface and the bottom surface of the insulation tongue 21*a*. The bracket 25*a* comprises two resilient supporting poles 251*a* connected between two opposite ends of the insulation tongue 21*a* and the mounting block 40*a*. The mounting block 40*a* defines a receiving space 41*a* to receive a rear end of the insulation tongue 21*a*.

In the embodiment, the number of each row of electric coupling pins is four. Rear ends of the two rows of electric coupling pins are mounted to the mounting block 40*a*, and front ends of the two rows of electric coupling pines are received in the receiving space 41*a*. The top surface of each electric conduction bar 23*a* faces a corresponding one of the electric coupling pins locating above the insulation tongue 21*a*, and the bottom surface of each electric conduction bar 23*a* faces a corresponding one of the electric coupling pins locating below the insulation tongue 21*a*. The electric coupling pins above the installation assembly 20 are a first negative power supply coupling pin 102*a*, a first positive signal power supply coupling pin 104*a*, a first negative signal power coupling pin 106*a*, and a first positive power supply coupling pin 108*a*, in sequence from a first side to a second side of the receiving space 41*a*. The electric coupling pins below the installation assembly 20*a* are a second positive power supply coupling pin 110*a*, a second negative signal power coupling pin 112*a*, a second positive signal power supply coupling pin 114*a*, and a second negative power supply coupling pin 116*a*, in sequence from the first side to the second side of the receiving space 41*a*. The bracket 25*a* is parallel to the electric coupling pins.

The double sided circuit board 60*a* is installed in the receiving space 41*a* of the mounting block 40*a*, and the double sided circuit board 60*a* is electrically coupled to the main body 300. The first negative power supply coupling pin 102*a*, the first positive signal power supply coupling pin 104*a*, the first negative signal power coupling pin 106*a*, and the first positive power supply coupling pin 108*a* are electrically coupled to a first side of the double sided circuit board 60*a*. The second positive power supply coupling pin 110*a*, the second negative signal power coupling pin 112*a*, the second positive signal power supply coupling pin 114*a*, and the second negative power supply coupling pin 116*a* are electrically coupled to a second side of the double sided circuit board 60*a*. The first negative power supply coupling pin 102*a* is electrically coupled to the second negative power supply coupling pin 116*a* by the double sided circuit board 60*a*. The first positive signal power supply coupling pin 104*a* is electrically coupled to the second positive signal power supply coupling pin 114*a* by the double sided circuit board 60*a*. The first negative signal power coupling pin 106*a* is electrically coupled to the second negative signal power coupling pin 112*a* by the double sided circuit board 60*a*. The first positive power supply coupling pin 108*a* is electrically coupled to the second positive power supply coupling pin 110*a* by the double sided circuit board 60*a*.

Figure 15:
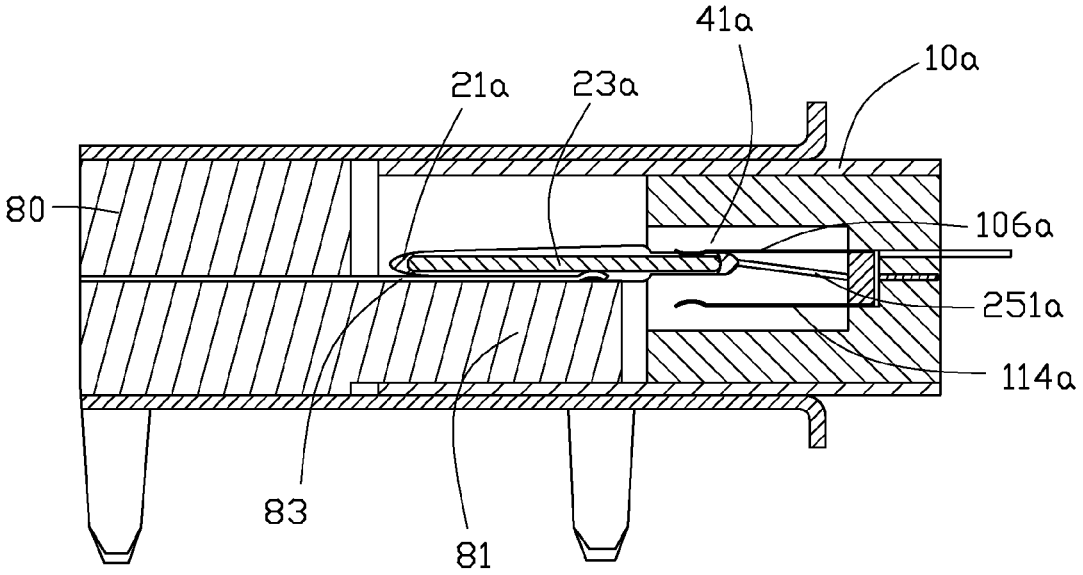
FIG. 15 is an assembled view of the USB connector of FIG. 12 and a common USB connector in a first state.

FIG. 15 illustrates the fourth embodiment of the USB connector 100 connecting with a common USB jack 80 in a first state. The common USB jack 80 comprises a tongue 81 and four electric conduction pieces 83 mounted on the tongue 81. The USB connector 100 of the fourth embodiment is inserted into the common USB jack 80, the tongue 81 of the common USB jack 80 presses a side of the front end of the insulation tongue 21*a* adjacent to the second positive power supply coupling pin 110*a*, the second negative signal power coupling pin 112*a*, the second positive signal power supply coupling pin 114*a*, and the second negative power supply coupling pin 116*a*, to move the installation assembly 20*a* towards the first negative power supply coupling pin 102*a*, the first positive signal power supply coupling pin 104*a*, the first negative signal power coupling pin 106*a*, and the first positive power supply coupling pin 108*a*, and deform the resilient supporting poles 251*a*. The first negative power supply coupling pin 102*a*, the first positive signal power supply coupling pin 104*a*, the first negative signal power coupling pin 106*a*, and the first positive power supply coupling pin 108*a* respectively abut against the top surfaces of the corresponding electric conduction bars 23*a*. The electric conduction pieces 83 of the common USB jack 80 respectively abut against the bottom surfaces of the corresponding electric conduction bars 23*a*. The common USB jack 80 is electrically coupled to the USB connector 100.

Figure 16:
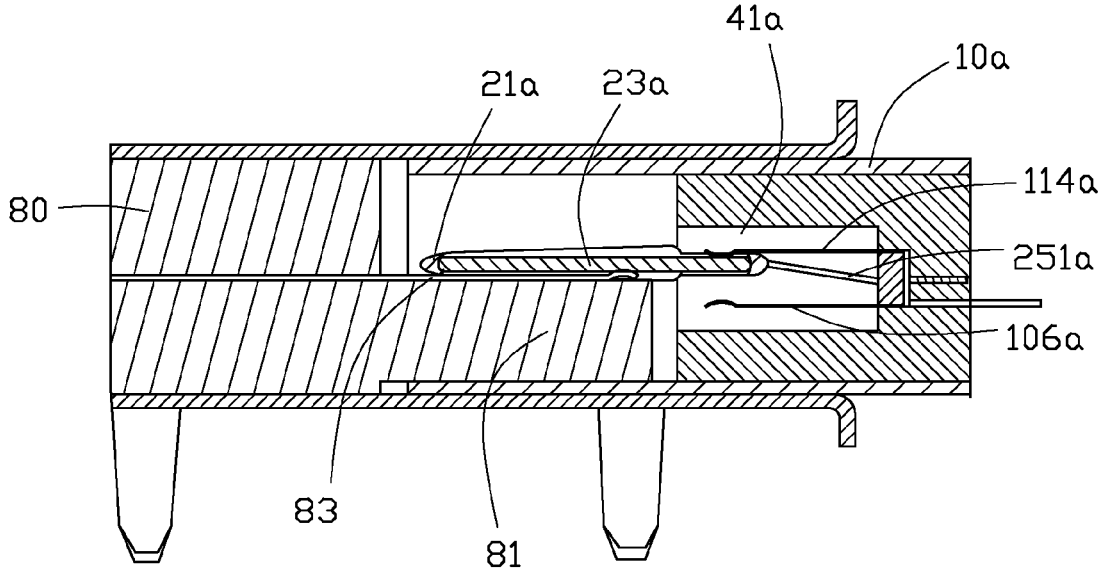
FIG. 16 is similar to FIG. 15, but shows the USB connector of FIG. 12 and the common USB connector in a second state.

FIG. 16 illustrates the fourth embodiment of the USB connector 100 connecting with the common USB jack 80 in a second state. The USB connector 100 is pulled out from the common USB jack 80, the resilient supporting poles 251*a* are restored to bias the installation assembly 20*a* to move back. The USB connector 100 is inverted, and is inserted into the USB jack 80. The tongue 81 of the common USB jack 80 presses an opposite side of the front end of the insulation tongue 21*a* adjacent to the first negative power supply coupling pin 102*a*, the first positive signal power supply coupling pin 104*a*, the first negative signal power coupling pin 106*a*, and the first positive power supply coupling pin 108*a*, to move the installation assembly 20*a* towards the second positive power supply coupling pin 110*a*, the second negative signal power coupling pin 112*a*, the second positive signal power supply coupling pin 114*a*, and the second negative power supply coupling pin 116*a*, and deform the resilient supporting poles 251*a*. The second positive power supply coupling pin 110*a*, the second negative signal power supply coupling pin 112*a*, the second positive signal power coupling pin 114*a*, and the second negative power supply coupling pin 116*a* are respectively abut against the bottom surfaces of the corresponding electric conduction bars 23*a*. The electric conduction pieces 83 of the common USB jack 80 respectively abut against the top surfaces of the corresponding electric conduction bars 23*a*. The common USB jack 80 is electrically coupled to the USB connector 100.

Figure 17:
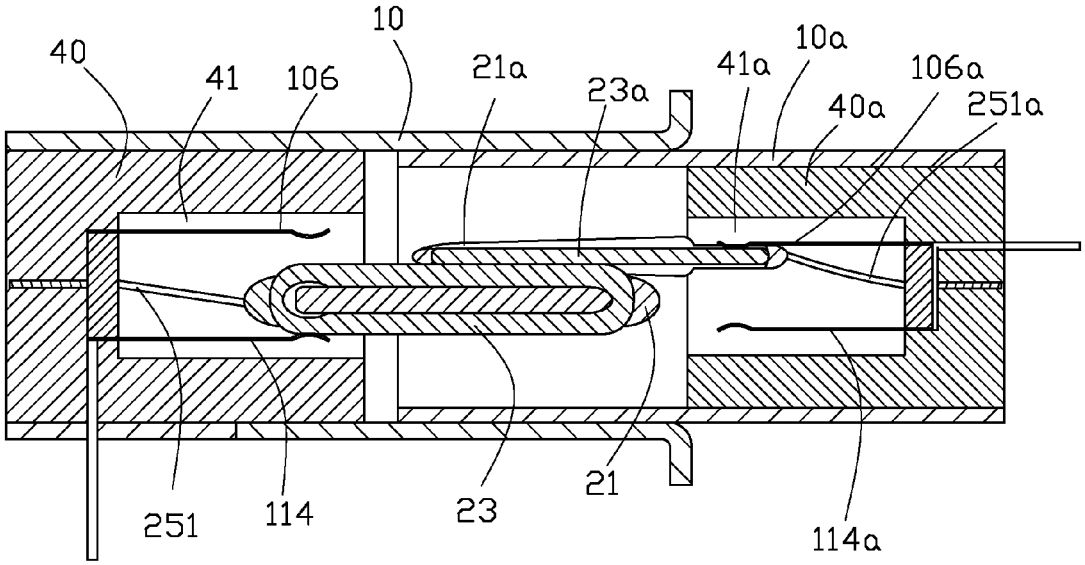
FIG. 17 is an assembled view of the USB connector of FIG. 12 and the USB connector of FIG. 3 in a first state.

FIG. 17 illustrates the fourth embodiment of the USB connector 100 connected to the first embodiment of the USB connector 100 in a first state, the fourth embodiment of the USB connector 100 is inserted in the first embodiment of the USB connector 100. The front end of the insulation tongue 21*a* of the fourth embodiment of the USB connector 100 presses the front end of the top surface of the insulation tongue 21 of the first embodiment of the USB connector 100, to move the insulation tongue 21 towards the second positive power supply coupling pin 110, the second negative signal power coupling pin 112, the second positive signal power supply coupling pin 114, and the second negative power supply coupling pin 116, to move the insulation tongue 21*a* towards the first negative power supply coupling pin 102*a*, the first positive signal power supply coupling pin 104*a*, the first negative signal power coupling pin 106*a*, and the first positive power supply coupling pin 108*a*, and to deform the resilient supporting poles 251 and 251*a*. The first negative power supply coupling pin 102*a*, the first positive signal power supply coupling pin 104*a*, the first negative signal power coupling pin 106*a*, and the first positive power supply coupling pin 108*a* respectively abut against the corresponding electric conduction bars 23*a*. The second positive power supply coupling pin 110, the second negative signal power coupling pin 112, the second positive signal power supply coupling pin 114, and the second negative power supply coupling pin 116 respectively abut against the bottom surfaces of the corresponding electric conduction bars 23. The top surfaces of the electric conduction bars 23 respectively abut against the corresponding electric conduction bars 23*a*. The fourth embodiment of the USB connector 100 is electrically coupled to the first embodiment of the USB connector 100.

Figure 18:
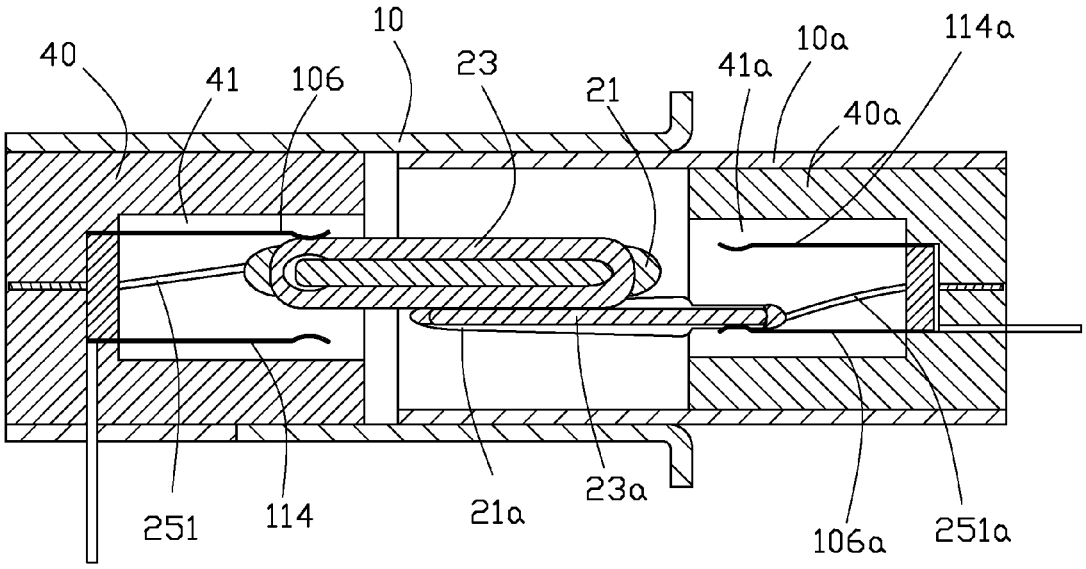
FIG. 18 is similar to FIG. 17, but shows the USB connector of FIG. 12 and the USB connector of FIG. 3 in a second state.

FIG. 18 illustrates the fourth embodiment of the USB connector 100 connected to the first embodiment of the USB connector 100 in a second state, the fourth embodiment of the USB connector 100 is pulled out from the first embodiment of the USB connector 100, the resilient supporting poles 251 and 251*a* are restored to bias the installation assembly 20 and 20*a* to move back. The fourth embodiment of the USB connector 100 is inverted, and is inserted to the first embodiment of the USB connector 100. The front end of the insulation tongue 21*a* presses the front end of the bottom surface of the insulation tongue 21, to move the insulation tongue 21 towards the first negative power supply coupling pin 102, the first positive signal power supply coupling pin 104, the first negative signal power coupling pin 106, and the first positive power supply coupling pin 108, to move the insulation tongue 21*a* towards the first negative power supply coupling pin 102*a*, the first positive signal power supply coupling pin 104*a*, the first negative signal power coupling pin 106*a*, and the first positive power supply coupling pin 108*a*, and to deform the resilient supporting poles 251 and 251*a*. The first negative power supply coupling pin 102*a*, the first positive signal power supply coupling pin 104*a*, the first negative signal power coupling pin 106*a*, and the first positive power supply coupling pin 108*a* respectively abut against the corresponding electric conduction bars 23*a*. The first negative power supply coupling pin 102, the first positive signal power supply coupling pin 104, the first negative signal power coupling pin 106, and the first positive power supply coupling pin 108 respectively abut against the top surfaces of the corresponding electric conduction bars 23. The bottom surfaces of the electric conduction bars 23 respectively abut against the corresponding electric conduction bars 23*a*. The fourth embodiment of the USB connector 100 is electrically coupled to the first embodiment of the USB connector 100.

Figure 19:
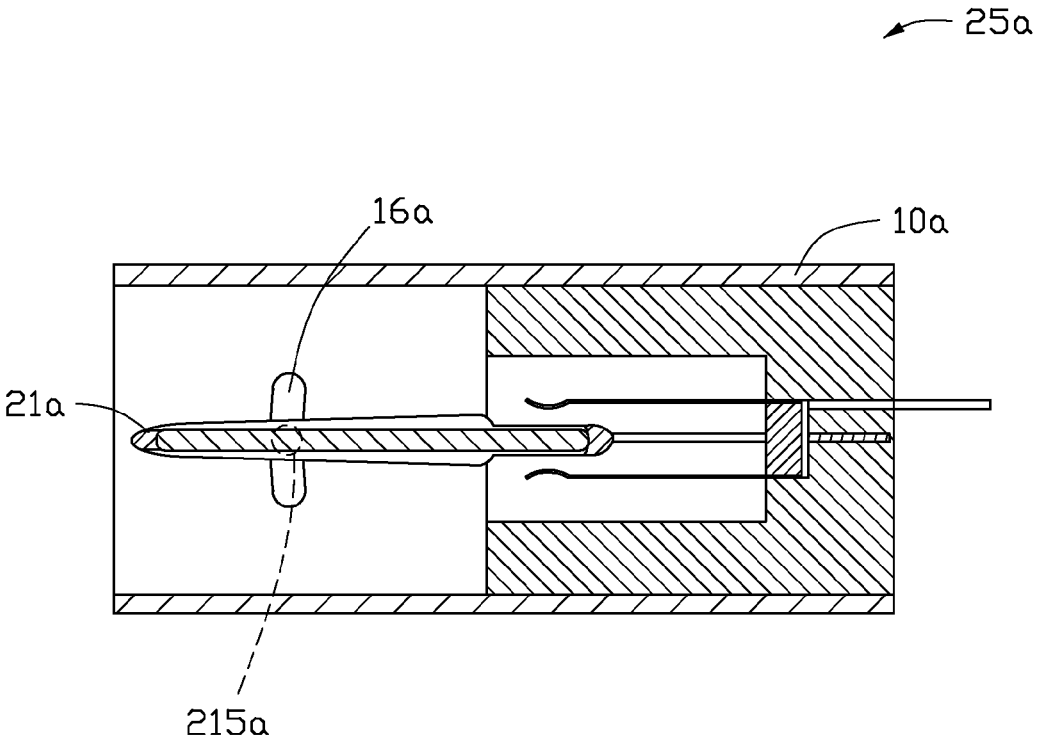
FIG. 19 is a side cross sectional view of a fifth embodiment of the USB connector of FIG. 1.

FIG. 19 illustrates a fifth embodiment of the USB connector 100, and the fifth embodiment of the USB connector 100 is substantially similar to the fourth embodiment of the USB connector 100. In the fifth embodiment, each of left and right sides of the case 10*a* defines an arc-shaped guiding slot 16*a* adjacent to the insulation tongue 21*a*. Top and bottom ends of each guiding slot 16*a* are behind a middle of the guiding slot 16*a*. Two sliding poles 215*a* extend out from two opposite sides of the insulation tongue 21*a*, to be slidably received in the corresponding guiding slot 16*a*.

Figure 20:
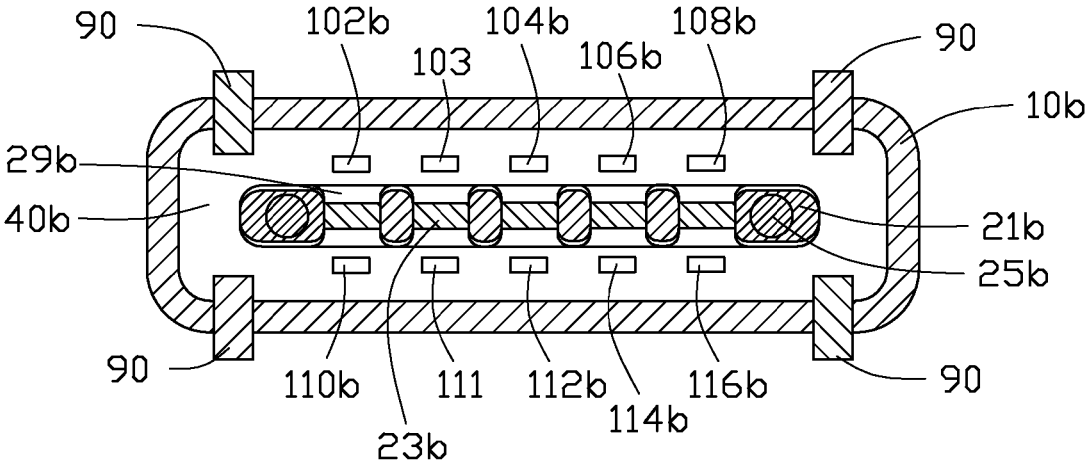
FIG. 20 is a front elevational and cross sectional view of a sixth embodiment of USB connector of FIG. 1.

FIG. 20 illustrates a sixth embodiment of the USB connector 100, and the sixth embodiment of the USB connector 100 is substantially similar to the fourth embodiment of the USB connector 100. In the sixth embodiment, the USB connector 100 is a Micro USB plug, and the USB connector 100 comprises a case 10*b*, an insulation tongue 21*b*, a mounting block 40*b* mounted to a rear end of the case 10*b*, a bracket 25*b*, and two rows of electric coupling pins located in the mounting block 40*b* and respectively above and below the insulation tongue 21*b*. The insulation tongue 21*b* defines five spaced receiving slots 29*b* extending through top and bottom surfaces of the insulation tongue 21*b*. The receiving slots 29*b* are spaced in a left-to-right direction of the insulation tongue 21*b*. Five electric conduction bars 23*b* respectively installed in the five spaced receiving slots 29*b* of the insulation tongue 21*b*. An upper side and a lower side of a front end of the insulation tongue 21*b* are cambered. In the embodiment, the number of each row of electric coupling pins is five. The top surface of each electric conduction bar 23*b* faces a corresponding one of the electric coupling pines locating above the insulation tongue 21*b*, and the bottom surface of each electric conduction bar 23*b* faces a corresponding one of the electric coupling pins locating below the insulation tongue 21*b*.

The electric coupling pins locating above the insulation tongue 21*b* are a first negative power supply coupling pin 102*b*, a first distinguishing coupling pin 103, a first positive signal power supply coupling pin 104*b*, a first negative signal power coupling pin 106*b*, and a first positive power supply coupling pin 108*b*, in sequence from a first side to a second side of the mounting block 40*b*. The electric coupling pins locating below the insulation tongue 21*b* are a second positive power supply coupling pin 110*b*, a second negative signal power coupling pin 111, a second positive signal power supply coupling pin 112*b*, a second distinguishing coupling pin 114*b*, and a second negative power supply coupling pin 116*b*, in sequence from the first side to the second side of the mounting block 40*b*. The electric coupling pins locating above the insulation tongue 21*b* and the electric coupling pines locating below the insulation tongue 21*b* are reversely and symmetrically arranged by type. The case 10*b* comprises two pairs of resilient hooks 90 respectively located at two opposite sides of the case 10*b*, and a distal end of each hook 90 extends through the corresponding sides of the case 10*b*. When the sixth embodiment of the USB connector 100 is connected to another connector, the hooks 90 can latch the another connector.

Figure 21:
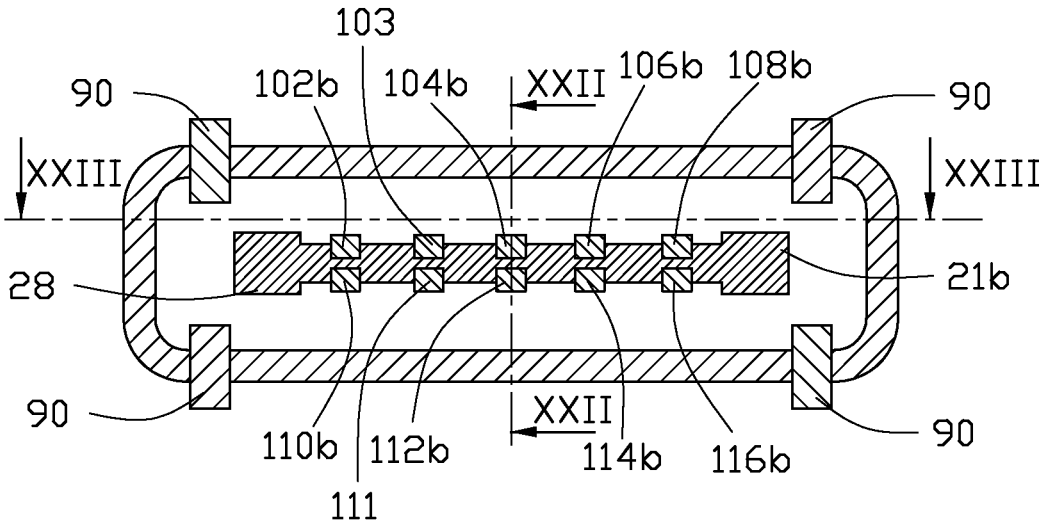
FIG. 21 is a front elevational and cross sectional view of a seventh embodiment of USB connector of FIG. 1.
Figure 22:
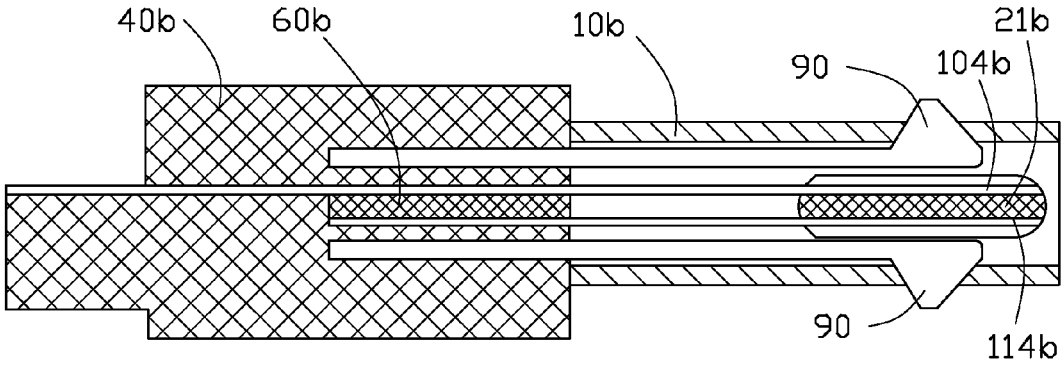
FIG. 22 is a cross sectional view of FIG. 21, taken along line XXII-XXII.
Figure 23:
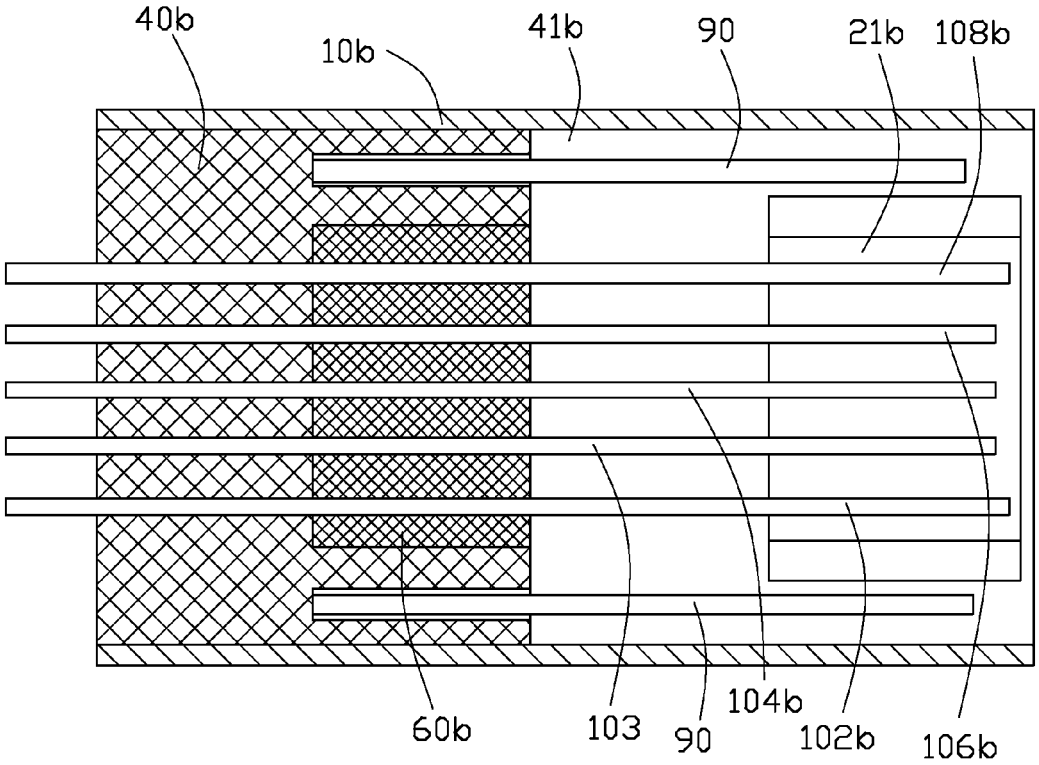
FIG. 23 is a cross sectional view of FIG. 21, taken along line XXIII-XXIII.

FIGS. 21-23 illustrate a seventh embodiment of the USB connector 100, and the seventh embodiment of the USB connector 100 is substantially similar to the sixth embodiment of the USB connector 100. In the seventh embodiment, the USB connector 100 is a Micro USB plug, and the electric conduction bars 23*b* and the bracket 25*b* are omitted. The seventh embodiment of the USB connector 100 comprises a case 10*b*, an insulation tongue 21*b*, a mounting block 40*b* mounted to a rear end of the case 10*b*, a double sided circuit board 60*b*, and two rows of resilient and electric coupling pins respectively mounted on top and bottom sides of the insulation tongue 21*b*. An upper side and a lower side of a front end of the insulation tongue 21*b* are cambered. Two pairs of guiding portions 28 respectively protrude out from two opposite sides of the top and bottom surfaces of the insulation tongue 21*b*, and each guiding portion 28 extends along a fore-and-aft direction of the USB connector 100.

One row of the electric coupling pins locating at the top side of the insulation tongue 21*b* are a first negative power supply coupling pin 102*b*, a first distinguishing coupling pin 103, a first positive signal power supply coupling pin 104*b*, a first negative signal power coupling pin 106*b*, and a first positive power supply coupling pin 108*b*, in sequence from a first side to a second side of the mounting block 40*b*. Front ends of the electric coupling pins locating at the top side of the insulation tongue 21*b* are mounted on the top surface of the insulation tongue 21*b*. The other row of the electric coupling pins locating at the bottom side of the insulation tongue 21*b* are a second positive power supply coupling pin 110*b*, a second negative signal power coupling pin 111, a second positive signal power supply coupling pin 112*b*, a second distinguishing coupling pin 114*b*, and a second negative power supply coupling pin 116*b*, in sequence from the first side to the second side of the mounting block 40*b*. The double sided circuit board 60*b* is installed to the mounting block 40 band electrically coupled to the main body 300. Rear ends of the first negative power supply coupling pin 102*b*, the first distinguishing coupling pin 103, the first positive signal power supply coupling pin 104*b*, the first negative signal power coupling pin 106*b*, and the first positive power supply coupling pin 108*b* extend through and are mounted to the mounting block 40*b*, and are electrically coupled to a first side of the double sided circuit board 60*b*. Rear ends of the second positive power supply coupling pin 110*b*, the second negative signal power coupling pin 111, the second positive signal power supply coupling pin 112*b*, the second distinguishing coupling pin 114*b*, and the second negative power supply coupling pin 116*b* are mounted to the mounting block 40*b*, and are electrically coupled to a second side of the double sided circuit board 60*b*. The first negative power supply coupling pin 102*b* is electrically coupled to the second negative power supply coupling pin 116*b* by the double sided circuit board 60*b*. The first distinguishing coupling pin 103 is electrically coupled to the second distinguishing coupling pin 114*b* by the double sided circuit board 60*b*. The first positive signal power supply coupling pin 104*b* is electrically coupled to the second positive signal power supply coupling pin 112*b* by the double sided circuit board 60*b*. The first negative signal power coupling pin 106*b* is electrically coupled to the second negative signal power coupling pin 111 by the double sided circuit board 60*b*. The first positive power supply coupling pin 108*b* is electrically coupled to the second positive power supply coupling pin 110*b* by the double sided circuit board 60*b*. The insulation tongue 21*b* is supported by the two rows of resilient and electric coupling pins. The case 10*b* comprises two pairs of resilient hooks 90 respectively located at two opposite sides of the case 10*b*, and a distal end of each hook 90 extends through the corresponding sides of the case 10*b*.

In use, the seventh embodiment of the USB connector 100 is inserted in a common USB jack, the insulation tongue 21*b* abuts against a tongue of the common USB jack. When a top surface of the insulation tongue 21*b* abuts against the tongue of the common USB jack, the insulation tongue 21*b* moves down, and deforms the electric coupling pins, until the USB connector 100 is electrically coupled to the common USB jack. When a bottom surface of the insulation tongue 21*b* abuts against the tongue of the common USB jack, the insulation tongue 21*b* moves up, and deforms the electric coupling pins, until the USB connector 100 is electrically coupled to the common USB jack. The hooks 90 of the USB connector 100 latch the common USB jack.

The seventh embodiment of the USB connector 100 is pulled out from the common USB jack, the electric coupling pins are restored to bias the insulation tongue 21*b* to move back.

Figure 24:
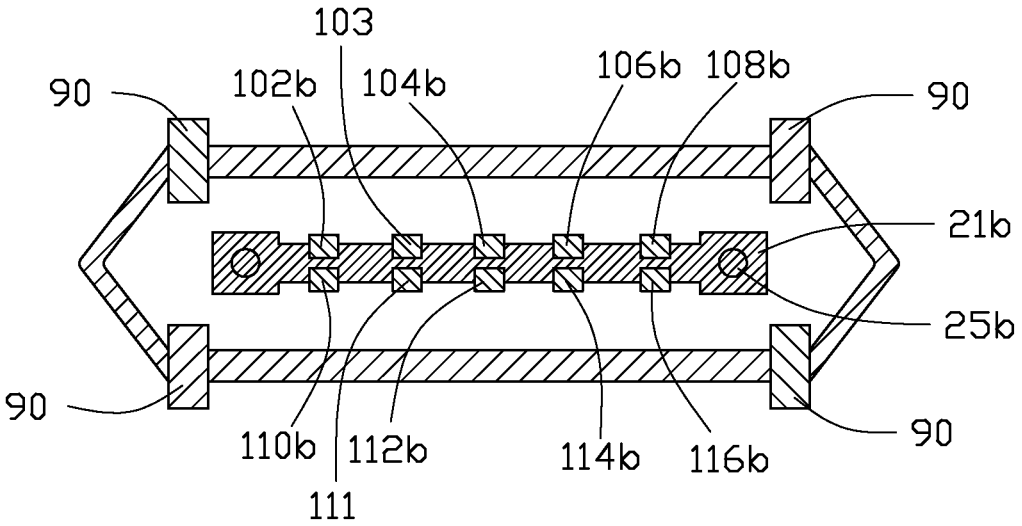
FIG. 24 is a front elevational and cross sectional view of an eighth embodiment of USB connector of FIG. 1.

FIG. 24 illustrates an eighth embodiment of the USB connector 100, and the eighth embodiment of the USB connector 100 is substantially similar to the seventh embodiment of the USB connector 100. In the eighth embodiment, the USB connector 100 further comprises a resilient bracket 25*b* located between the insulation tongue 21*b* and the mounting block 40*b*, and two opposite end surfaces of the case 10*b* protrude out to form two diamond surfaces or two arc-shaped surfaces.

Figure 25:
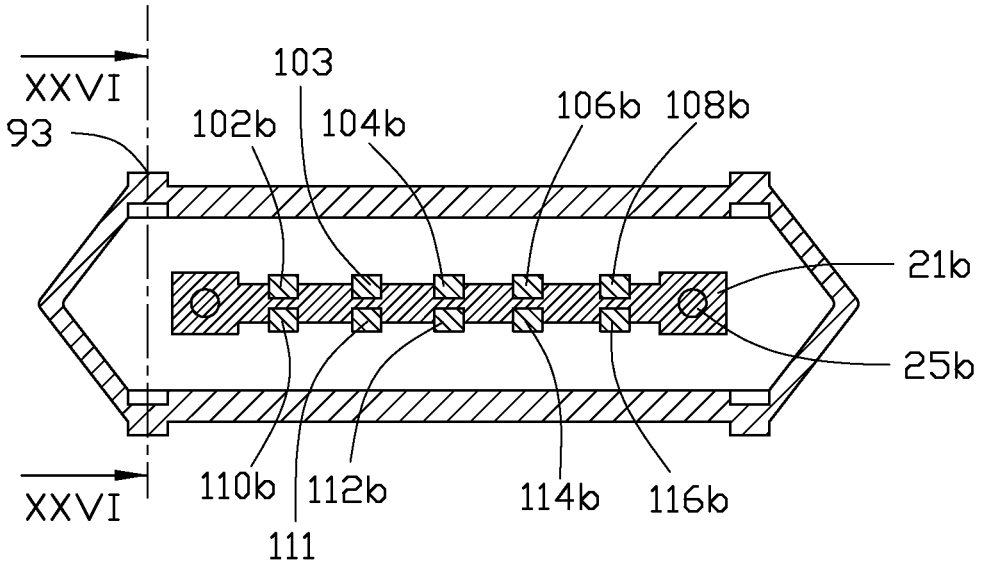
FIG. 25 is a front elevational and cross sectional view of a ninth embodiment of USB connector of FIG. 1.
Figure 26:
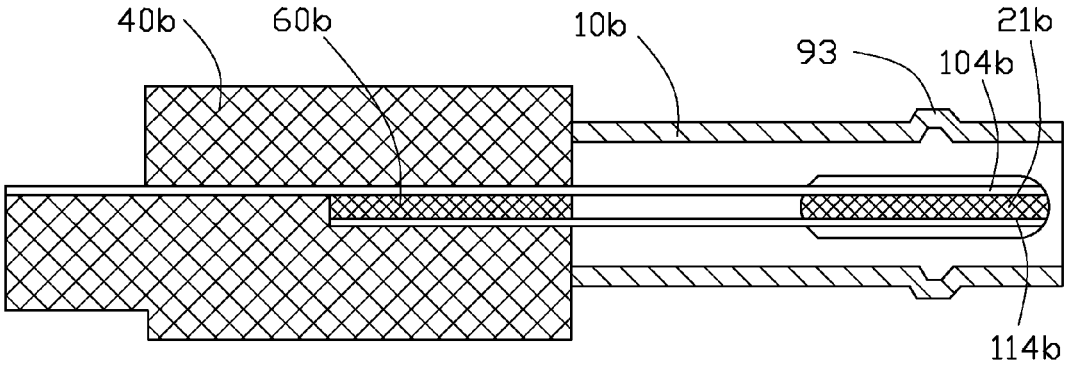
FIG. 26 is a cross sectional view of FIG. 25, taken along line XXVI-XXVI.

FIGS. 25-26 illustrate a ninth embodiment of the USB connector 100, and the ninth embodiment of the USB connector 100 is substantially similar to the seventh embodiment of the USB connector 100. In the ninth embodiment, the USB connector 100 omits the two pairs of resilient hooks 90, the case 10*b* comprises two pairs of resilient latching blocks 93 respectively protruded out from two opposite sides of the case 10*b*. When the ninth embodiment of the USB connector 100 is connected to another connector, the latching blocks 93 can latch the another connector.

In another embodiment, the USB connector 100 can be a USB 3.0 plug or a USB 3.1 plug.

The embodiments shown and described above are only examples. Many details are often found in the art such as the other features of a USB jack, USB plug and USB connector assembly. Therefore, many such details are neither shown nor described. Even though numerous characteristics and advantages of the embodiments have been set forth in the foregoing description, together with details of the structure and function of the embodiments, the present disclosure is illustrative only, and changes may be made in details, including in the matters of shape, size, and arrangement of parts within the principles of the embodiments to the full extent indicated by the broad general meaning of the terms in which the appended claims are expressed.

What is claimed is:

1. A universal serial bus (USB) connector comprising:

a case having a front end, a middle end, and a rear end, the front end defining an inlet hole;

an insulation tongue located at the middle of the inlet hole of the case, wherein a front end of the insulation tongue has an upper side and a lower side that are each cambered;

a plurality of electric conduction bars installed on the insulation tongue, and spaced in a horizontal direction of the insulation tongue;

a resilient supporting pole connected between a rear end of the insulation tongue and the case; and a first row of electric coupling pins located above the installation tongue, and a second row of electric coupling pins located below the insulation tongue;

wherein each of the plurality of electric conduction bars have a top surface and a bottom surface, respectively, exposed out of an upper surface and a lower surface of the insulation tongue, the top surface of each electric conduction bar faces a corresponding one of the electric coupling pins above the insulation tongue, and the bottom surface of each electric conduction bar faces a corresponding one of the electric coupling pins locating below the insulation tongue, the electric coupling pins locating above the insulation tongue and the electric coupling pins locating below the insulation tongue are reversely and symmetrically arranged by type, each electric coupling pin locating above the insulation tongue is electrically coupled to the corresponding type of electric coupling pin locating below the insulation tongue, and the insulation tongue is movable along a vertical direction by deforming the resilient supporting pole.

2. The USB connector of claim 1, wherein the USB connector is a USB 2.0 jack, a USB 1.1 jack, a USB 2.0 plug, or a USB 1.1 plug, the number of the electric conduction bars is four, the number of each row of the electric coupling pins is four, the electric coupling pins locating above the insulation tongue are a first negative power supply coupling pin, a first positive signal power supply coupling pin, a first negative signal power coupling pin, and a first positive power supply coupling pin, in sequence from a first side to a second side of the insulation tongue, the electric coupling pins locating below the insulation tongue are a second positive power supply coupling pin, a second negative signal power coupling pin, a second positive signal power supply coupling pin, and a second negative power supply coupling pin, in sequence from the first side to the second side of the insulation tongue, the first negative power supply coupling pin is electrically coupled to the second negative power supply coupling pin, the first positive signal power supply coupling pin is electrically coupled to the second positive signal power supply coupling pin, the first negative signal power coupling pin is electrically coupled to the second negative signal power coupling pin, the first positive power supply coupling pin is electrically coupled to the second positive power supply coupling pin.

3. The USB connector of claim 1, further comprising a double sided circuit board installed in the case, wherein each electric coupling pin locating above the insulation tongue is electrically coupled to the corresponding type of electric coupling pin locating below the insulation tongue by the double sided circuit board.

4. The USB connector of claim 1, further comprising a mounting block mounted in a rear end of the case, wherein a front surface of the mounting block defines a receiving space opposite to the inlet hole, a rear end of the resilient supporting pole is mounted to the mounting block and received in the receiving space, a rear end of each electric coupling pin is mounted to the mounting block and a front end of each electric coupling pin is received in the receiving space.

5. The USB connector of claim 1, wherein each electric conduction bar extends along a fore-and-aft direction of the USB connector, the top surface of each electric conduction bar protrudes out of the top surface of the insulation tongue, and the bottom surface of each electric conduction bar protrudes out of the bottom surface of the insulation tongue.

6. An electronic device, comprising:

a main body; and a universal serial bus (USB) connector installed to the main body, and comprising:

a case having a front end, a middle end, and a rear end, the front end defining an inlet hole;

an insulation tongue located at the middle of the inlet hole of the case, wherein the front end of the insulation tongue has an upper side and lower side that are each cambered;

a plurality of electric conduction bars installed on the insulation tongue, and spaced in a horizontal direction of the insulation tongue;

a resilient supporting pole connected between a rear end of the insulation tongue and the case; and a first row of electric coupling pins located above the installation tongue, and a second row of electric coupling pins located below the insulation tongue;

wherein each of the plurality of electric conduction bars have a top surface and a bottom surface, respectively, exposed out of an upper surface and a lower surface of the insulation tongue, the top surface of each electric conduction bar faces a corresponding one of the electric coupling pins above the insulation tongue, and the bottom surface of each electric conduction bar faces a corresponding one of the electric coupling pins below the insulation tongue, the electric coupling pins above the insulation tongue and the electric coupling pins below the insulation tongue are reversely and symmetrically arranged by type, each electric coupling pin locating above the insulation tongue is electrically coupled to the corresponding type of electric coupling pin locating below the insulation tongue, and the insulation tongue is movable along a vertical direction by deforming the resilient supporting pole.

* * * * *